United States Patent [19]

Rich

[11] 4,041,261

[45] Aug. 9, 1977

[54] HIGH CURRENT CAPACITY ROD ARRAY VACUUM ARC DISCHARGE DEVICE

[75] Inventor: Joseph A. Rich, Schenectady, N.Y.

[73] Assignee: General Electric Company, Schenectady, N.Y.

[21] Appl. No.: 589,892

[22] Filed: June 24, 1975

[51] Int. Cl.[2] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,489,873 | 1/1970 | Kurtz et al. | 200/144 B |
| 3,643,047 | 1/1972 | Rich | 200/144 B |
| 3,727,018 | 4/1973 | Wesoloski et al. | 200/144 B |
| 3,814,880 | 6/1974 | Hundstad | 200/144 B |
| 3,953,693 | 4/1976 | Pflanz | 200/144 B |
| 3,969,598 | 7/1976 | Sofianek et al. | 200/144 B |

*Primary Examiner*—Robert S. Macon

*Attorney, Agent, or Firm*—Marvin Snyder; Joseph T. Cohen; Jerome C. Squillaro

[57] ABSTRACT

A vacuum arc discharge device comprises a rod array structure of interdigitated, continuous current-carrying electrodes and arc electrodes, with an assembly of movable contacts near one end of the device respectively coupled to the continuous current-carrying electrodes. Continuous and fault currents are thus divided among the contact assemblies, reducing total magnetic force tending to separate the contacts and increasing current capacity of the device.

20 Claims, 5 Drawing Figures

Fig. 2
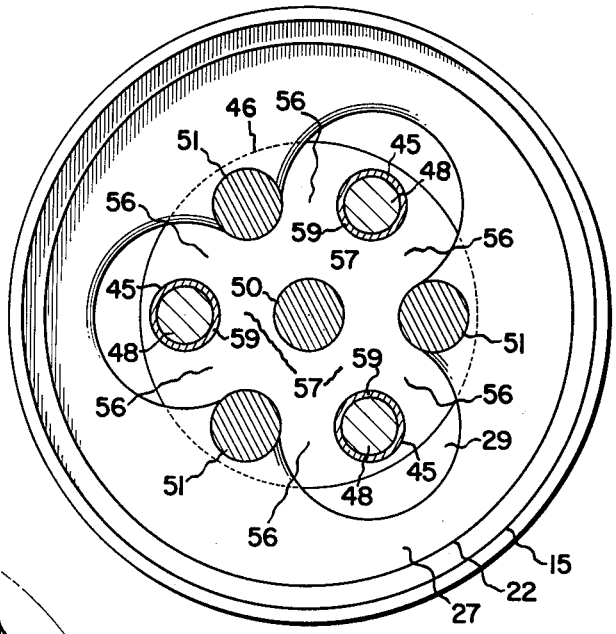
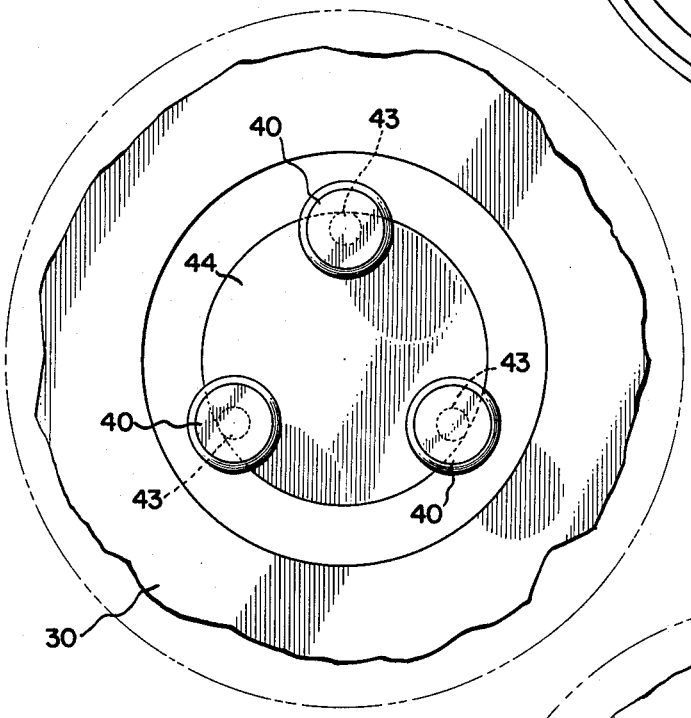
Fig. 3A
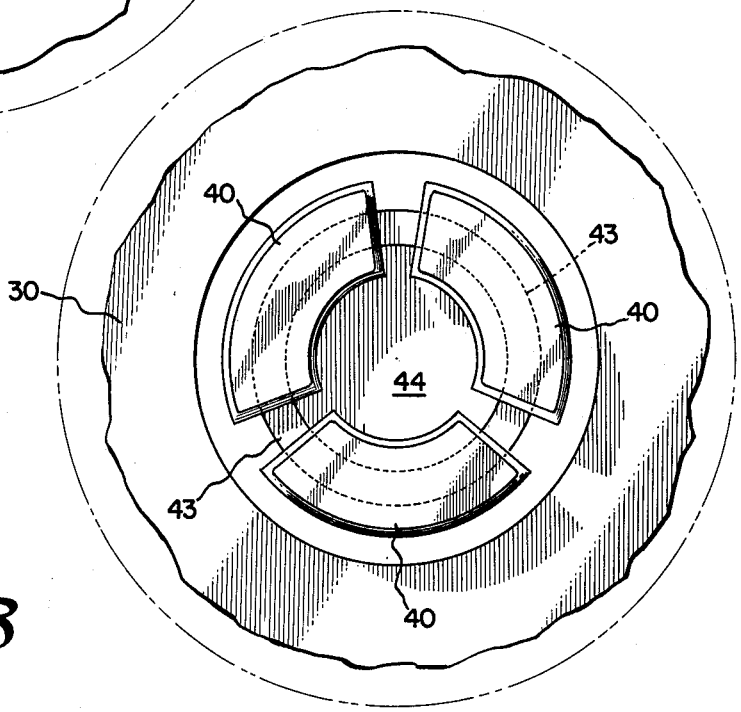
Fig. 3B

HIGH CURRENT CAPACITY ROD ARRAY VACUUM ARC DISCHARGE DEVICE

INTRODUCTION

This invention relates to improved vacuum arc devices for protecting electrical apparatus by interrupting overload current, and more particularly to improved vacuum switches wherein total normal load current is carried by a plurality of contact pairs in an array of interdigitated, continuous current-carrying electrodes and arc electrodes.

Vacuum arc discharge devices conventionally interrupt currents of up to 40 kiloamperes at up to 45 kilovolts. In seeking to achieve higher interruption ratings of sufficient magnitude to permit use of vacuum switches in transmission line circuit breakers, however, it is necessary to accommodate high momentary currents along with large continuous currents through the device.

When carrying current, a magnetic force tending to separate the contact pair through which continuous current passes, is created in the device. This force is proportional to the square of the current. If the force applied to the contacts is insufficient to keep them closed while passing a fault current or high momentary current, which may be in the range of 60 kiloamperes to 100 kiloamperes for example, "contact popping" (i.e., a momentary opening and closing of the contacts) occurs, resulting in severe erosion and scarring of the contacts. Hence the contact actuating mechanism must be capable of providing the necessary force to maintain the contacts closed not only during flow of normal continuous current but also during existence of high momentary currents. In the General Electric PV-8 vacuum switch employed in 242 kilovolt circuit breakers, for example, a closing force of approximately 1200 pounds is required to hold the contacts together for fault currents of 40 kiloamperes r.m.s. or 100 kiloamperes peak. Conventional vacuum switches open at random in any cycle and a finite time elapses between sensing of a fault and parting of the contacts; thus before the contacts part they may carry a large fault current momentarily, resulting in contact popping and consequential damage to the contacts.

For limiting the amount of current that a vacuum arc discharge device is required to interrupt, a plurality of simultaneously-operable interrupters connected in parallel have been employed. Such apparatus is described and claimed in T. H. Lee U.S. Pat. No. 3,441,800, issued Apr. 29, 1969, and assigned to the instant assignee. Apparatus such as this, of course, involves the expense of using additional interrupters, as well as overcoming any problems associated with imperfect synchronization of contact operation.

In conventional vacuum switches capable of carrying large faults currents, it is necessary to provide a heavy, bulky, complex actuating mechanism in order to overcome inertia of the movable components and respond quickly to fault currents. In the present invention, total mass of the movable components is reduced by situating the movable contact assembly close to one end of the switch so as to obviate need for long, heavy, contact stems. This allows a concomitant reduction in weight, bulk and complexity of the actuating mechanism.

Arc interruption in vacuum interrupters results in metal particles and/or metal vapor being emitted in the arcing region. If rod electrodes are employed, the emitted metal is likely to be splattered thereon. This can be detrimental in that the resulting sharp projections and other irregularities on rod electrodes can lead to breakdown under high voltage electrical stress. The present invention provides for reduction in splatter of metal against rod electrodes in a vacuum interrupter, and confines such splatter mainly to surfaces that are relatively unstressed electrically.

Accordingly, one object of the invention is to provide compact apparatus having contacts capable of interrupting large amplitude currents but requiring reduced total force to maintain the contacts closed during flow of high, momentary current.

Another object is to provide a vacuum arc discharge device of small moving contact mass which allows rapid interruption of large amplitude currents.

Another object is to provide a vacuum arc discharge device in which total current is divided among a plurality of separated contact pairs.

Another object is to provide a vacuum arc discharge device employing contacts that are shielded from an array of rod electrodes.

Briefly, in accordance with a preferred embodiment of the invention, a vacuum arc discharge device comprises a hermetically sealed evacuated envelope containing an assembly of contact pairs arranged in a predetermined pattern, each contact pair including a movable contact and a fixed contact. Each of the movable contacts is electrically interconnected and mechanically coupled to a common, movable support. A first plurality of electrically conducting rods is contained in the envelope, each rod of the first plurality being mechanically and electrically coupled to a respective one of the fixed contacts and to a common metallic support plate. A second plurality of electrically conducting rods contained in the envelope are interdigitally spaced in alternating fashion with respect to the first plurality of rods. Each rod of the second plurality is mechanically and electrically connected to a conducting portion of the envelope. A second metallic plate mechanically and electrically connecting each rod of the second plurality to the envelope has an opening therein to permit passage therethrough of each rod of the first plurality.

BRIEF DESCRIPTION OF THE DRAWINGS

The features of the invention believed to be novel are set forth with particularly in the appended claims. The invention itself, however, both as to organization and method of operation, together with further objects and advantages thereof, may best be understood by reference to the following description taken in conjunction with the accompanying drawings in which:

FIG. 2 is a sectional view along line 2—2 of the vacuum arc discharge device of FIG. 1;

FIGS. 3A and 3B are sectional view along line 3—3 of two separate embodiments of the vacuum arc discharge device of FIG. 1.

Description of Typical Embodiments

Figure 1:
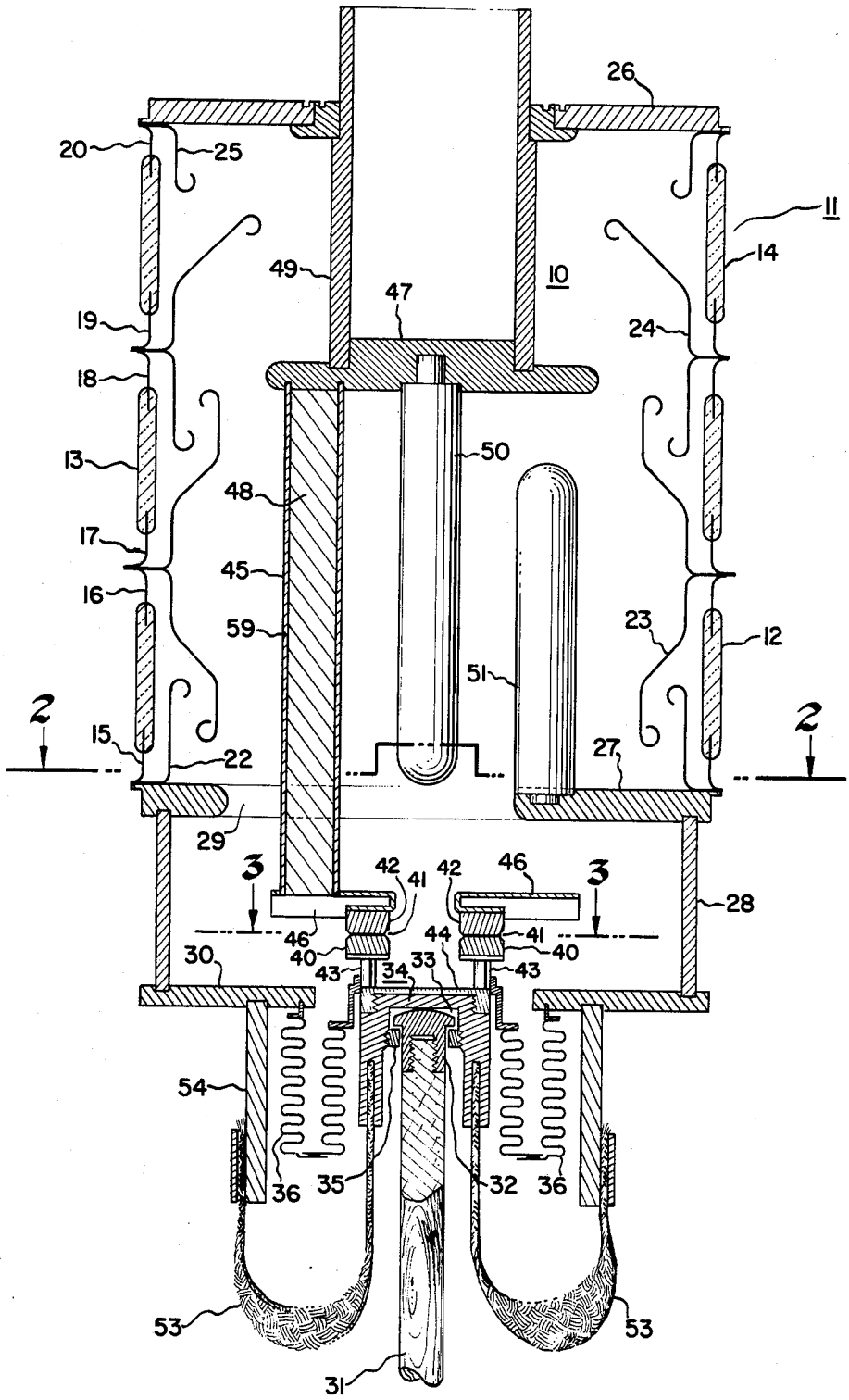
FIG. 1 is a longitudinal, sectional, schematic drawing of a vacuum arc discharge device constructed in accordance with the invention.

FIG. 1 illustrates a vacuum are discharge device 10, which comprises a vacuum switch type of vacuum interrupter, constructed in accordance with the teachings of the invention. Thus vacuum switch 10 comprises an envelope 11, the interior of which is evacuated of gas. Envelope 11 comprises insulating sidewall members 12, 13 and 14, such as glass, hermetically sealed to metallic flanges 15 and 16, 17 and 18, and 19 and 20, respectively. Flange 2 is hermetically sealed to metallic endwall 26, while flange 15 is hermetically sealed to a metal plate 27. Metallic shield members 22, 23 24 and 25 prevent molten metal particles and/or metal vapor emitted in the arcing region from adhering to, and electrically short-circuiting, insulating sidewall members 12, 13 and 14. Additionally, shield members 22 and 25 serve to relieve voltage stresses at the glass-to-metal seals of flanges 15 and 20, respectively, by grading the electric fields thereat. Shield members 23 and 24 are welded or otherwise affixed to flanges 16 and 17, and flanges 18 and 19, respectively, while shield members 22 and 25 are welded or otherwise connected to support plate 27 and endwall 26, respectively. Those skilled in the art will recognize that other envelope or shield configurations, or both, may alternatively be employed.

The lower portion of envelope 11 includes a metallic sidewall member 28 welded or otherwise hermetically sealed at one end to metal plate 27 and at the other end to metallic endwall 30. A light, strong actuator rod 31 comprised of an insulating material, such as fiberglass or resin-impregnated wood, is screwed or otherwise fitted into an actuator head 32 having a large radius of curvature and comprised of metal such as Duralumin aluminum alloy. The curved surface of head 32 is retained against the upper surface 33 of a cavity in a movable contact base 34, preferably constructed of Duralumin alloy, as by means of a collar 35 screwed or otherwise fitted into the cavity of contact base 34, and permits limited rocking movement of contact base 34 about head 32. A concentric double bellows 36 is employed to provide a short bellows length, which might otherwise be excessive for long arc gaps in the device. In the alternative, a welded bellows may be employed. In either event, the bellows is hermetically sealed at its inner portion to cap 44 of contact base 34 and at its outer portion to endwall 30.

Each movable contact 40 of a plurality of contact pairs 41 is supported by contact base 34 through a respective one of a plurality of conductive posts 43, each post, in turn, protruding from a threaded cap 44 fitted onto contact base 34. Alternatively, a single, continuous, cylindrical conductive member may be substituted for posts 43. Each stationary contact 442 of contact pairs 41 is affixed to a respective flange 47 at one end of a separate tubular conducting rod or rod electrode 45, respectively, passing through an opening 29 in plate 27. The opposite end of each of electrodes 45 is affixed, in common, to a metallic plate 47 supported from upper endwall 26 by a cylindrical metallic member 49 which is electrically connected to an external circuit (not shown). Thus continuous current and fault current through the device is divided into a number of portions equal to the number of rod electrodes 45, conveniently illustrated as three but which may be any suitable number. Each of rod electrodes 45 includes a core 48 of high thermal and electrical conductivity; for example, each of rod electrodes 45 may comprise a steel jacket 59 encasing a copper core 48. In the alternative, each of rod electrodes 45 may be constructed as a heat pipe.

A plurality of conducting rods or rod electrodes 51, mounted on metal plate 27 and equal in number to the number of rod electrodes 45, are interdigitated, in alternating fashion, with rod electrodes 45. The resulting interdigitated array, in this embodiment, surrounds a central conducting rod or rod electrode 50 mounted at the center of metallic support plate 47. The geometrical pattern of the rod electrode array is ascertainable in FIG. 2, which represents a section taken along line 2—2 of the structure shown in FIG. 1. Each of rod electrodes 50 and 51 is preferably of solid construction, but may be hollow if desired.

Instead of the conventional single contact pair typically employed in commercial vacuum switches, the invention utilizes a plurality of well-separated contact pairs 41. Since the magnetic force tending to separate the contacts of a single contact pair is proportional to the square of the current passing through the contact pair, this force on any contact pair utilized in the invention is reduced from that extant in conventional single contact pair vacuum switches by the square of the number of contact pairs employed in the invention (assuming that normal load current passing through the vacuum switch divided itself equally among the contact pairs). Since all the movable contacts are actuated from the same mechanism, i.e., actuator rod 31, total force required to hold the contacts closed against the magnetic force tending to separate the contacts is $n(F/n^2)$ or $F/n$, where F is the magnetic force that would tend to separate the contacts of a single contact pair carrying the total current, and $n$ is the number of contact pairs sharing the total current in the device. Thus where $n$ equals 3, the total force required to hold any contact pair closed is reduced to one-third that required to hold closed a single butt-contact pair carrying the same total current.

In operation under normal load conditions, current is conducted through the vacuum switch along a path defined by cylindrical member 49, rod electrodes 45 and their associated contact pairs 41, respectively, and movable contact base 34, through a flexible copper braid 53 which conducts the current to a copper cylinder 54 attached to baseplate 30. Cylinder 54 not only collects the current from the array of rod electrodes 45 and 51, but also serves as a terminal for connecting the vacuum switch to an external circuit (not shown). Cylinder 54 additionally acts as a protective enclosure for bellows assembly 36.

Until an overload condition occurs, the mating contacts of each of contact pairs 41 are forced together by pressure from actuator rod 31, augmented by atmospheric pressure acting against movable contact base 34 due to the evacuated condition of vacuum switch 10. When an overload condition occurs, movable contacts 40 of contact pairs 41 are separated from stationary contacts 42 by retraction of rod 31, brought about by actuating means (not shown) external to the vacuum switch. Consequently an electric arc is struck in the gap between the contacts in each pair of contact assemblies 41. Movable contacts 40, when fully separated from stationary contacts 42, are retracted into baseplate 30 so as to achieve more uniform distribution of electric fields in the contact gap region at such time.

When movable contacts 40 have been sufficiently separated from stationary contacts 42, the arcs extend themselves from rod electrodes 45 and 50 to rod electrodes 51. This transfer in arc locations is initially achieved by the arcs throwing themselves radially outward from each pair of contacts. Each pair of contacts serves as a source of conductive plasma comprised of metallic particles, similar to the trigger assembly of a triggerable vacuum gap, so that there is sufficient plasma in the contact region to cause arcing in the rod electrode structure. The plasma in the contact region moves upward through the open space surrounded by the contact array and through the opening in plate 27, into the region surrounded by rod electrodes 45 and 51. Consequently, arcs jump across gaps 56 between adjacent rod electrodes 45 and 51, and across gaps 57 between rod electrode 50 and each of rod electrodes 45. Once an arc is struck across a gap between rod electrodes, it is maintained preferentially by these electrodes since a substantially lower arc voltage drop appears across the gaps of the rod array compared to the arc voltage drop across the assembly of contact pairs 41.

The plurality of high current arcs maintained by the overload current passing through the array of rod electrodes is sustained by a conductive plasma comprising metallic particles from the rod electrodes. This plasma permits the arcs to be transferred across gaps 56 and across gaps 57, forming parallel conducting paths. These arcs exist until the value of arcing current passes through a zero value and conduction ceases, allowing the metal vapor to cool and condense upon the surfaces of the shields and rod electrodes, as well as other accessible surfaces. When the next cycle of alternating voltage is applied across gaps 56 and across gaps 57, the high dielectric strength of the vacuum within the device prevents reestablishment of the arcs, so that current does not resume flowing.

Since contact assemblies 41 are situated near one end of the device, part of the movable contact assembly (i.e., contact base 34) can be located outside the vacuum envelope. Consequently, lightweight and strong materials of good conductivity, such as Duralumin which would not be tolerated inside the vacuum envelope because of its relatively low melting point and tendency to emit gas when heated in vacuum, can be employed. This results in a reduction of movable mass, with its attendant advantage of faster operating speed.

Movable contacts 40, supported from contact base 34, are preferably orientable; that is, they are self-adjusting to compensate for any possible unequal erosion on the arced contact pairs. This is facilitated by employing a curved surface on actuator head 32 to permit contact base 34 to rock, to a limit extent, about head 32, and by concentric double bellows 36, which also serves to shorten bellows length so as to prevent such length from becoming excessive for long arc gaps between the contacts of each contact pair.

Support plate 27 not only carries fault current for rods 51 but, in combination with envelope sections 28 and 30, provides a metal enclosure for separable contact pairs 41 which confines molten metal splattered from the contacts substantially to a region well away from the rod electrodes. Thus the desirable smooth surface of rod electrodes 45, 50 and 51 is preserved for an extended length of time.

In Kurtz et al. application Ser. No. 579,122, filed May 19, 1975 and assigned to the instant assignee, a pair of vacuum interrupter contacts is shown situated within a conductive tube or enclosure which, inter alia, tends to confine splattered from the contacts substantially to a region well away from rod electrodes in the interrupter. This feature is not claimed in the aforementioned Kurtz et al. application inasmuch as it was invented by me as a part of the present invention and, accordingly, is claimed herein.

Although contact assemblies 41 are described as comprising disk contacts, which are of the general configuration shown in FIG. 3A, those skilled in the art will appreciate that, in the alternative, a pair of annular ring contacts, congruently sectored, may be employed. In such embodiment, each of the ring contacts is suitable sectored into individual contacts, as shown for movable contacts 40 in FIG. 3B. Each of the movable contacts mates with a respective one of stationary contacts 42 so that desired division of the current is maintained. Instead of being supported by posts, contacts 40 are supported by a single cylindrical conductive member 43 affixed to cap 44. The inner portion of bellows 36 may then be hermetically sealed at its inner portion to cylindrical member 43. The movable contacts are retractable into baseplate 30 to achieve a desirable distribution of electric field lines in the fully open gap position. Of course in the embodiment of FIG. 3A, the number of separable contacts may be increased in order to provide increased contact area. Additionally, the number of stationary contacts 40 in the embodiment of FIG. 3B may be increased by reducing the circular arc length of each stationary contact. For ease in understanding relative locations, the dot-washed line in each of FIGS. 3A and 3B represents the relative alignment of flange 46.

Figure 4:
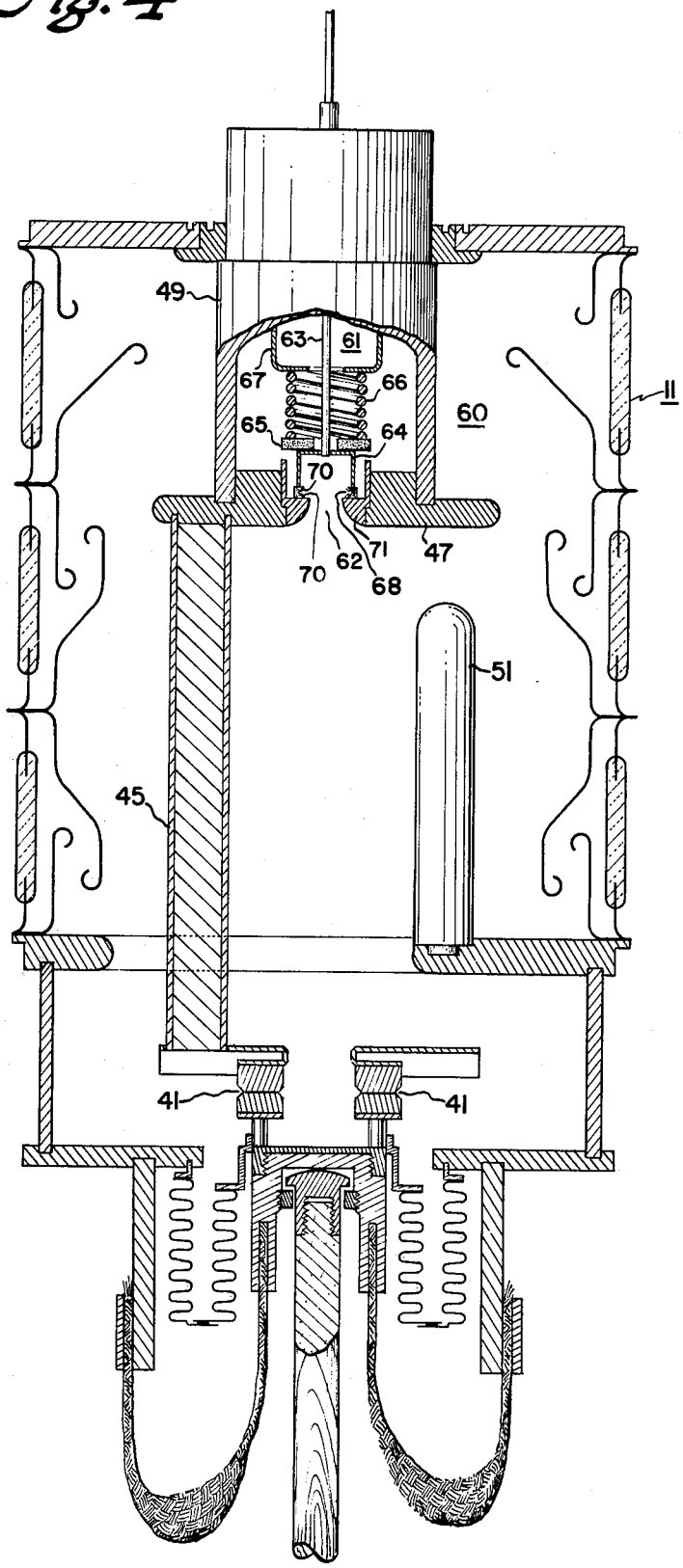
FIG. 4 is a longitudinal, partially broken away, schematic drawing of another embodiment of a vacuum arc discharge device constructed in accordance with the invention.

In FIG. 4, a triggered vacuum switch 60 is illustrated. This device is constructed essentially similar to vacuum switch 10 shown in FIG. 1, the major difference being removal of central rod electrode 50 and addition of a plasma trigger 61 enclosed in cylindrical metallic member 49 for directing a triggering plasma through an opening 62 in platform 47 into the interior of envelope 11.

As noted in Lee at al. U.S. Pat. No. 3,469,048, issued Sept. 23, 1969 and assigned to the instant assignee, distribution of total interrupting current among parallel-connected interrupters in order to reduce the interrupting duty imposed on each interrupter had been difficult to attain, one of the major reasons being that separation of contacts in the various interrupters rarely occurs precisely simultaneously. Consequently the last contacts to part carry all of the current at the time they part. An arc is thus established only at the last contacts to part, concentrating the entire interrupting duty on these contacts. Use of triggered vacuum interrupters in such application, however, allows distribution of the interrupting duty under high current conditions among parallel-connected interrupters without requiring large inductances coupled thereto in order to encourage establishment of arcs in all the interrupters and to force the arcs to share the current evenly. Moreover, after a current zero between a pair of parallel-connected interrupters, any high current interrupting duty imposed is distributed, even if contact-separation or arcing has occurred at only one of the interrupters prior to the current zero. Use of triggered vacuum interrupters also obviates any need for mechanically operating all of the parallel-connected interrupters in synchronism.

As pointed out in Kurtz et al. U.S. Pat. No. 3,489,873, issued Jan. 13, 1970 and assigned to the instant assignee, contact closing in the conventional type of vacuum interrupter is initiated prior to any arcing between the contacts, and any arcing that may occur at such time is of very short duration. In the triggered vacuum interrupter of Kurtz et al. U.S. Pat. No. 3,489,873, however, arcing persists over a much longer period, occurring during the entire closing operation. One reason for the need for this type of operation is described in Lee U.S. Pat. No. 3,319,121, issued May 9, 1967 and assigned to the instant assignee.

Plasma trigger 61 in the triggered vacuum switch of FIG. 4 is of the type described in extensive detail in J. M. Lafferty U.S. Pat. No. 3,465,192, issued Sept. 2, 1969 and assigned to the instant assignee. The trigger comprises a trigger anode lead 63 electrically connected to anode cup 64 which, in turn, is seated upon an apertured ceramic disk 65. A helical spring 66 bearing against a support member 67 holds ceramic disk 65 firmly against anode 65 which retains an annular trigger gap 68, formed in an electrically conductive, metallic, ionizable material-supplying film 70, in place against the inner surface of a tapered nozzle 71. The nozzle is tightly fitted into a central opening formed in plate 47 and fastened thereto securely to assure good mechanical and electrical contact with a vacuum seal.

In operation, contact pairs 41 would normally be open. A pulse produced as a result of an overload current is applied to anode lead 63 with respect to nozzle 47, causing vacuum breakdown across gap 68 which results in injection of an electron-ion plasma into the interior of envelope 11. This plasma immediately triggers an arc between each pair of adjacent rod electrodes 45 and 51, so that the overload current is instantaneously short-circuited in triggered vacuum switch 60 through the high current arcs in the interelectrode gaps between adjacent rod electrodes. To limit the period over which current flows through these arcs, contact pairs 40 are driven into engagement immediately following establishment of the arcs. This extinguishes the arcs and causes the continuing current to flow through the contacts. When the current through the contacts falls below a predetermined level, the contacts are again parted. This type of triggered vacuum switch operation is described in greater detail in the aforementioned D.R. Kurtz et al. U.S. Pat. No. 3,489,873.

The foregoing described compact apparatus having contacts capable of interrupting large amplitude currents while requiring reduced total force to maintain the contacts closed during flow of a high, momentary current. Only small mass moving contacts are employed, allowing rapid interruption of the large amplitude current. Total current through the device is divided among a plurality of separated contact pairs, resulting in reduced total force required to maintain the contacts closed against magnetically-induced force tending to open the contacts. The apparatus further provides shielding of an array of rod electrodes from the contacts pairs.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

I claim:

1. A vacuum arc discharge device comprising:

a hermetically sealed, evacuated envelope;

a plurality of contact pairs arranged in a predetermined pattern within said envelope, each of said contact pairs including a movable contact and a fixed contact, each of the movable contacts being electrically interconnected and mechanically coupled to a common, movable support having a major portion of its volume situated outside said envelope;

a first plurality of electrically conducting rods contained in said envelope, each rod of said first plurality being mechanically and electrically coupled to a respective one of the fixed contacts and to a common metallic support plate;

a second plurality of electrically conducting rods contained in said envelope and interdigitally spaced in alternating fashion with respect to said first plurality of rods; and a second metallic plate mechanically and electrically connecting each rod of said second plurality to said envelope, said second metallic plate having an opening therein to permit passage therethrough of each rod of said first plurality.

2. The vacuum arc discharge device of claim 1 including a central electrically conducting rod mechanically and electrically connected to said common metallic support plate and spaced apart from said first and second pluralities of rods.

3. The vacuum arc discharge device of claim 1 wherein said first and second pluralities of rods are arranged in an annular pattern surrounding said central rod.

4. The vacuum arc discharge device of claim 1 wherein said envelope includes an endwall, said discharge device further including a bellows hermetically sealing said movable support to said endwall.

5. The vacuum arc discharge device of claim 4 including actuator means having a curved head abutting said movable support so as to permit limited rocking movement of said movable support about said actuator means.

6. The vacuum arc discharge device of claim 2 wherein said envelope includes an endwall, said discharge device further including a bellows hermetically sealing said movable support to said endwall.

7. The vacuum arc discharge device of claim 6 including actuator means having a curved head abutting said movable support so as to permit limited rocking movement of said movable support about said actuator means.

8. The vacuum arc discharge device of claim 1 wherein said first plurality of electrically conducting rods includes core material of high thermal conductivity.

9. The vacuum arc discharge device of claim 2 wherein said first plurality of electrically conducting rods includes core material of high thermal conductivity.

10. The vacuum arc discharge device of claim 1 wherein said plurality of contact pairs comprises a movable ring and a fixed ring, said movable ring being sectored into a plurality of movable contacts and said fixed ring being sectored into a plurality of fixed contacts such that each of said movable contacts can mate with each of said fixed contacts, respectively.

11. The vacuum arc discharge device of claim 1 wherein each of said plurality of contact pairs comprises a movable contact and a stationary contact, said movable contacts being mechanically coupled so as to move in unison such that each of said movable contacts can mate in unison with each of said fixed contacts, respectively.

12. The vacuum arc discharge device of claim 1 including a trigger electrode assembly mechanically and electrically connected to said common metallic support plate and spaced apart from said first and second pluralities of rods.

13. The vacuum arc discharge device of claim 12 wherein said first and second pluralities of rods are arranged in an annular pattern surrounding said trigger electrode assembly.

14. The vacuum arc discharge device of claim 12 wherein said envelope includes an endwall, said discharge device further including a bellows hermetically sealing said movable support to said endwall.

15. The vacuum arc discharge device of claim 14 including actuator means having a curved head abutting said movable support so as to permit limited rocking movement of said movable support about said actuator means.

16. The vacuum arc discharge device of claim 12 wherein each of said plurality of contact pairs comprises a movable contact and a stationary contact, said movable contacts being mechanically coupled so as to move in unison such that each of said movable contacts can mate in unison with each of said fixed contacts, respectively.

17. A vacuum arc discharge device comprising:

a hermetically sealed, evacuated envelope;

an enclosure situated within said envelope;

at least one contact pair contained in said enclosure and including a movable contact and a fixed contact, said movable contact being mechanically and electrically connected to a movable support;

a first stationary electrically conducting rod contained in said envelope, said first rod being electrically connected to said fixed contact; and a second stationary electrically conducting rod contained in said envelope and spaced apart from said first rod by a predetermined distance, said second rod being electrically coupled to said moving contact, at least a portion of each of said first and second rods being situated external to said enclosure.

18. The vacuum arc discharge device of claim 17 wherein said envelope includes an endwall, said discharge device further including a bellows hermetically sealing said movable support to said endwall.

19. The vacuum arc discharge device of claim 17 wherein a major portion of the volume of said movable support is situated outside said envelope.

20. The vacuum arc discharge device of claim 18 wherein a major portion of the volume of said movable support is situated outside said envelope.

* * * * *